US009022524B2

(12) United States Patent
Owaki

(10) Patent No.: US 9,022,524 B2
(45) Date of Patent: May 5, 2015

(54) LIQUID EJECTING HEAD UNIT AND LIQUID EJECTING APPARATUS

(71) Applicant: Seiko Epson Corporation, Tokyo (JP)

(72) Inventor: Hiroshige Owaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/162,026

(22) Filed: Jan. 23, 2014

(65) Prior Publication Data

US 2014/0232787 A1 Aug. 21, 2014

(30) Foreign Application Priority Data

Feb. 15, 2013 (JP) ..... 2013-028231

(51) Int. Cl.
*B41J 2/14* (2006.01)
*B41J 2/055* (2006.01)
*B41J 2/155* (2006.01)

(52) U.S. Cl.
CPC ..... *B41J 2/055* (2013.01); *B41J 2/14233* (2013.01); *B41J 2/155* (2013.01); *B41J 2002/14241* (2013.01); *B41J 2002/14419* (2013.01)

(58) Field of Classification Search
CPC ..... B41J 2/14209; B41J 2/14233; B41J 2/14427; B41J 2/145; B41J 2/15; B41J 2/155; B41J 2/161; B41J 2/1623; B41J 2/1628; B41J 2/1631; B41J 2/1632; B41J 2/1639; B41J 2/1642; B41J 2002/14419; B41J 2002/11491; B41J 2202/20
USPC ..... 347/54, 68, 71, 84, 85, 47, 65, 72, 347/40–43
See application file for complete search history.

(56) References Cited

U.S. PATENT DOCUMENTS

| | | | | |
|---|---|---|---|---|
| 2006/0066687 | A1* | 3/2006 | Hori | 347/68 |
| 2010/0128089 | A1 | 5/2010 | Sugahara | |
| 2011/0199437 | A1* | 8/2011 | Miyata | 347/68 |
| 2011/0279545 | A1 | 11/2011 | Osaki et al. | |
| 2012/0229553 | A1* | 9/2012 | Owaki et al. | 347/19 |
| 2012/0249684 | A1* | 10/2012 | Okubo | 347/68 |
| 2012/0299997 | A1* | 11/2012 | Munakata et al. | 347/47 |

FOREIGN PATENT DOCUMENTS

| | | |
|---|---|---|
| JP | 2010-125597 | 6/2010 |
| JP | 2011-240521 | 12/2011 |

* cited by examiner

*Primary Examiner* — Manish S Shah
*Assistant Examiner* — Roger W Pisha, II

(57) ABSTRACT

A liquid ejecting head unit includes a first nozzle group including a plurality of nozzles, a second nozzle group including another plurality of nozzles, a first flow path substrate including a first pressure chamber group including a plurality of first pressure chambers that eject a liquid from the nozzles of the first nozzle group upon being subjected to a pressure, a second flow path substrate including a second pressure chamber group including a plurality of second pressure chambers that eject a liquid from the nozzles of the second nozzle group upon being subjected to a pressure, and a supply substrate including a first liquid supply path through which the liquid is supplied to the first pressure chamber group, and a second liquid supply path through which the liquid is supplied to the second pressure chamber group.

15 Claims, 10 Drawing Sheets

LIQUID EJECTING HEAD UNIT AND LIQUID EJECTING APPARATUS

CROSS REFERENCE TO RELATED APPLICATIONS

This application claims priority to Japanese Patent Application No. 2013-028231, filed on Feb. 15, 2013. The entire disclosure of Japanese Patent Application No. 2013-028231 is hereby incorporated herein by reference.

BACKGROUND

1. Technical Field

The present invention relates to a liquid ejecting head unit and a liquid ejecting apparatus.

2. Related Art

Generally, liquid ejecting apparatuses include a plurality of liquid ejecting heads, typically ink jet recording heads, combined and aligned in a predetermined direction, so as to constitute a head unit including an elongate nozzle row, for example as disclosed in JP-A-2010-125597. In the liquid ejecting apparatus according to this literature, four liquid ejecting heads arranged in a checkerboard pattern in a predetermined alignment direction are each supported by a head support member.

In addition, in the liquid ejecting apparatus the plurality of liquid ejecting head bodies are aligned (positioned) and supported by the head support member. Accordingly, the liquid ejecting heads are spaced from each other by a certain distance, so as to facilitate the liquid ejecting heads to be aligned.

Locating thus the liquid ejecting heads with a certain spacing between each other in order to align the liquid ejecting heads with each other leads to a disadvantage in that the overall size of the liquid ejecting head unit inevitably becomes larger.

Here, the mentioned drawback is not only incidental to the ink jet recording head unit, but broadly to liquid ejecting heads that eject a liquid other than ink.

SUMMARY

An advantage of some aspects of the invention is that a liquid ejecting head unit that can be built in a reduced size, and a liquid ejecting apparatus including such a liquid ejecting head unit are provided.

In an aspect, the invention provides a liquid ejecting head unit including a first nozzle group including a plurality of nozzles, a second nozzle group including a plurality of nozzles different from the nozzles of the first nozzle group, a first flow path substrate including a first pressure chamber group including a plurality of first pressure chambers that eject a liquid from the nozzles of the first nozzle group upon being subjected to a pressure, a second flow path substrate including a second pressure chamber group including a plurality of second pressure chambers that eject a liquid from the nozzles of the second nozzle group upon being subjected to a pressure, the second flow path substrate being different from the first flow path substrate, and a supply substrate including a first liquid supply path through which the liquid is supplied to the first pressure chamber group, and a second liquid supply path through which the liquid is supplied to the second pressure chamber group, the supply substrate being stacked on the first flow path substrate and the second flow path substrate, on the side of the nozzles.

In the thus-configured liquid ejecting head unit, the supply substrate is stacked on the first and the second flow path substrate, and therefore the head unit can be made smaller in size, than the case where the head body is fixed to a support member. The term "stacked" herein refers not only to the configuration in which the supply substrate is directly stacked on the flow path substrate, but also to a configuration in which another layer, for instance an adhesive layer, is interposed therebetween.

Preferably, the supply substrate may include a plurality of openings each communicating with one of the first and the second liquid supply path and formed in the supply substrate on a surface thereof oriented to the flow path substrate, and the liquid ejecting head unit may further include a housing including a plurality of cavities each communicating with one of the first and the second liquid supply path via the opening, the housing being mounted on the supply substrate on the side of the flow path substrate.

Preferably, each of the nozzle groups may include a plurality of nozzle rows each including the nozzles aligned in one direction, and the housing may include a plurality of cavities respectively corresponding to the nozzle rows. Forming thus the cavities in the housing for the respective nozzle rows suppresses a thermal impact from the cavity to other nozzle rows, and thereby improves the dispensation characteristics.

Alternatively, each of the nozzle groups may include a plurality of nozzle rows including the nozzles aligned in one direction, and the housing may include a cavity corresponding to the plurality of nozzle rows. Forming thus a single cavity for the plurality of nozzle rows simplifies the configuration of the housing.

The cavity may constitute a part of a manifold.

Preferably, at least the first flow path substrate may be provided on the supply substrate between a pair of the housings, and a nozzle plate including the nozzle group may be provided on the supply substrate at a position opposing the first flow path substrate. Further, the supply substrate may include the liquid supply path connecting between the cavity of the housing and the pressure chamber, and another liquid flow path connecting between the pressure chamber and the nozzle in the nozzle plate.

Alternatively, the liquid ejecting head unit may further include a nozzle plate including the first nozzle group, and a nozzle plate including the second nozzle group. In this case also, since the nozzle plates are respectively provided for the first and the second nozzle group on the supply substrate, the head unit can be built in a reduced size.

In another aspect, the invention provides a liquid ejecting apparatus including the foregoing liquid ejecting head unit. By including the liquid ejecting head unit having a reduced size and capable of suppressing the thermal impact, the liquid ejecting apparatus can achieve higher printing characteristics.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Liquid Ejecting Apparatus

Figure 1:
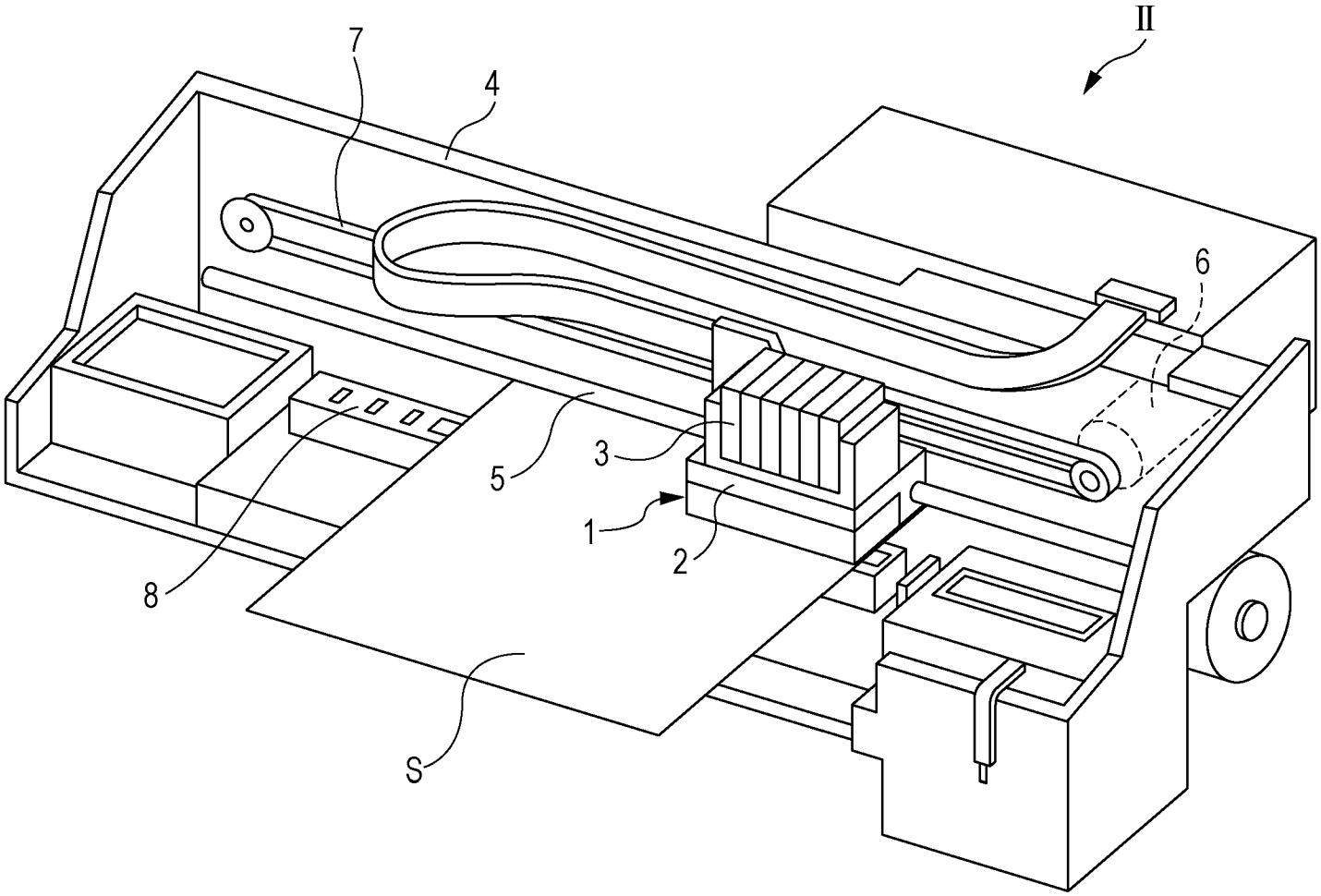
FIG. 1 is a perspective view showing a liquid ejecting apparatus according to a first embodiment of the invention.

FIG. 1 is a perspective view showing an ink jet recording apparatus, exemplifying the liquid ejecting apparatus, according to a first embodiment of the invention. As shown in FIG. 1, the ink jet recording apparatus II includes an ink jet recording head module (hereinafter, simply head module) 1 that dispenses ink droplets, exemplifying the liquid ejecting head in the invention, fixed to a carriage 2.

A plurality of ink cartridges 3 each containing an ink are removably mounted on the head module 1. In this embodiment, the ink cartridges 3 respectively contain a plurality of different color inks, such as black (B), light black (LB), cyan (C), magenta (M), and yellow (Y).

The carriage 2 with the head module 1 mounted thereon is attached to a carriage shaft 5 provided in an apparatus main body 4, so as to move in the axial direction of the carriage shaft 5. The carriage 2 is driven to move along the carriage shaft 5 by a driving force of a driving motor 6 transmitted to the carriage 2 via non-illustrated gears and a timing belt 7. The apparatus main body 4 includes a platen 8 mounted along the carriage shaft 5, and a recording medium S such as a paper sheet is transported over the platen 8, by a non-illustrated paper feed unit or the like.

Liquid Ejecting Head

Figure 2:
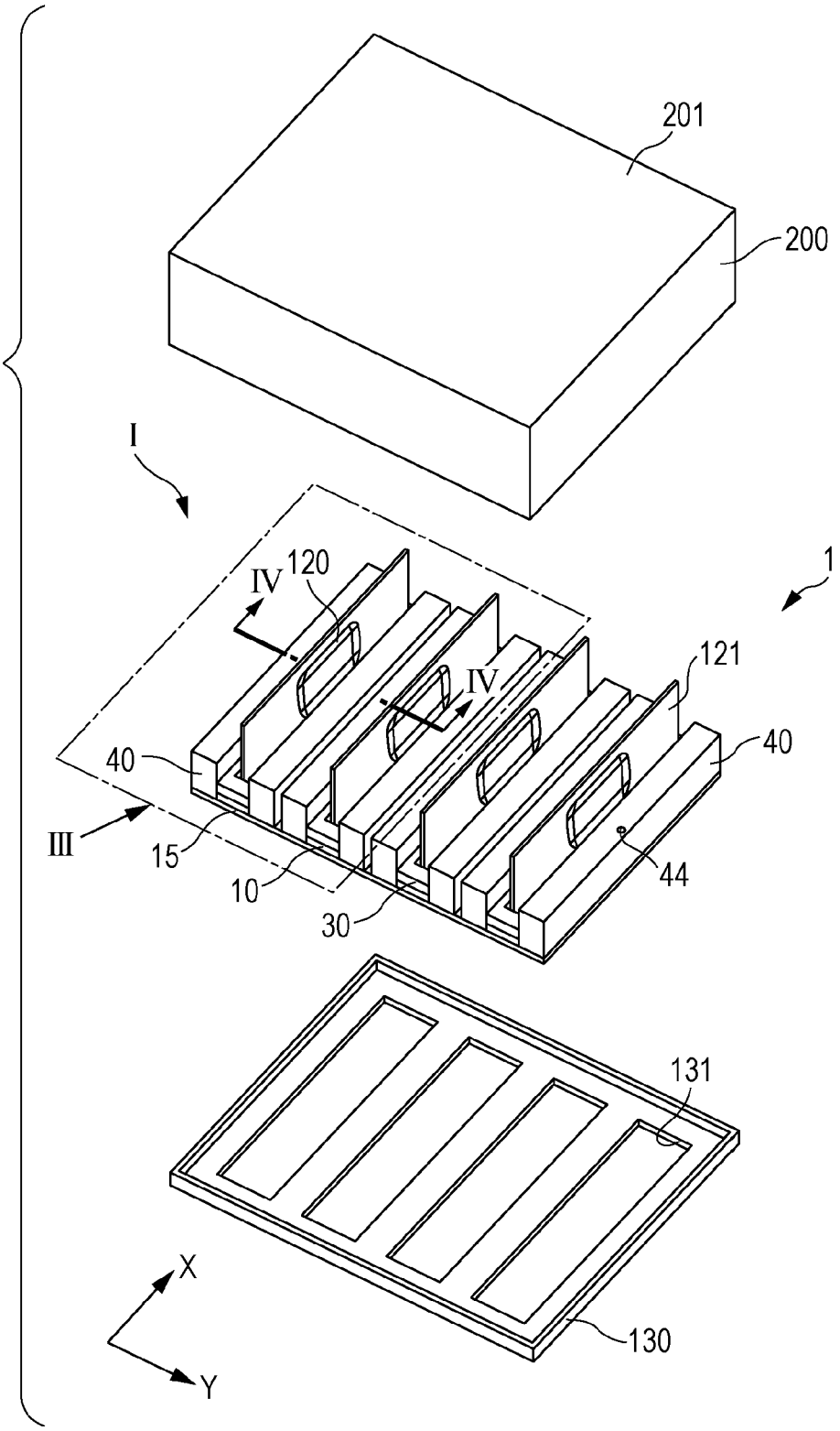
FIG. 2 is an exploded perspective view showing a head module including a head unit.

Referring to FIG. 2, the head module 1 will be described in details.

As shown in FIG. 2, the head module 1 includes a casing 200 having a cartridge base 201 on which the ink cartridges 3 (see FIG. 1) are mounted. The casing 200 includes thereinside an ink jet recording head unit (hereinafter, simply head unit) I, exemplifying the liquid ejecting head unit in invention.

Though not shown, an ink supply device for supplying the ink from the ink cartridge is provided on the cartridge base 201. The ink supply device may be, for example, a needle inserted in a non-illustrated ink inlet of the ink cartridge. Alternatively, the ink supply device may be a member disposed in contact with the ink inlet of the ink cartridge.

Ink flow paths are provided in the casing 200, and the ink from the ink cartridge is supplied to the ink flow path through the ink supply device. The ink introduced into the ink flow path flows into an introduction path 44 in the head unit I to be described in details here below.

A fixing plate 130 is provided on the casing 200, on the face thereof opposite to the cartridge base 201. The fixing plate 130 includes a plurality of openings 131, through which nozzle plates (described later) of the head unit I are exposed. The ink is dispensed from nozzle openings formed in the nozzle plate.

Figure 3:
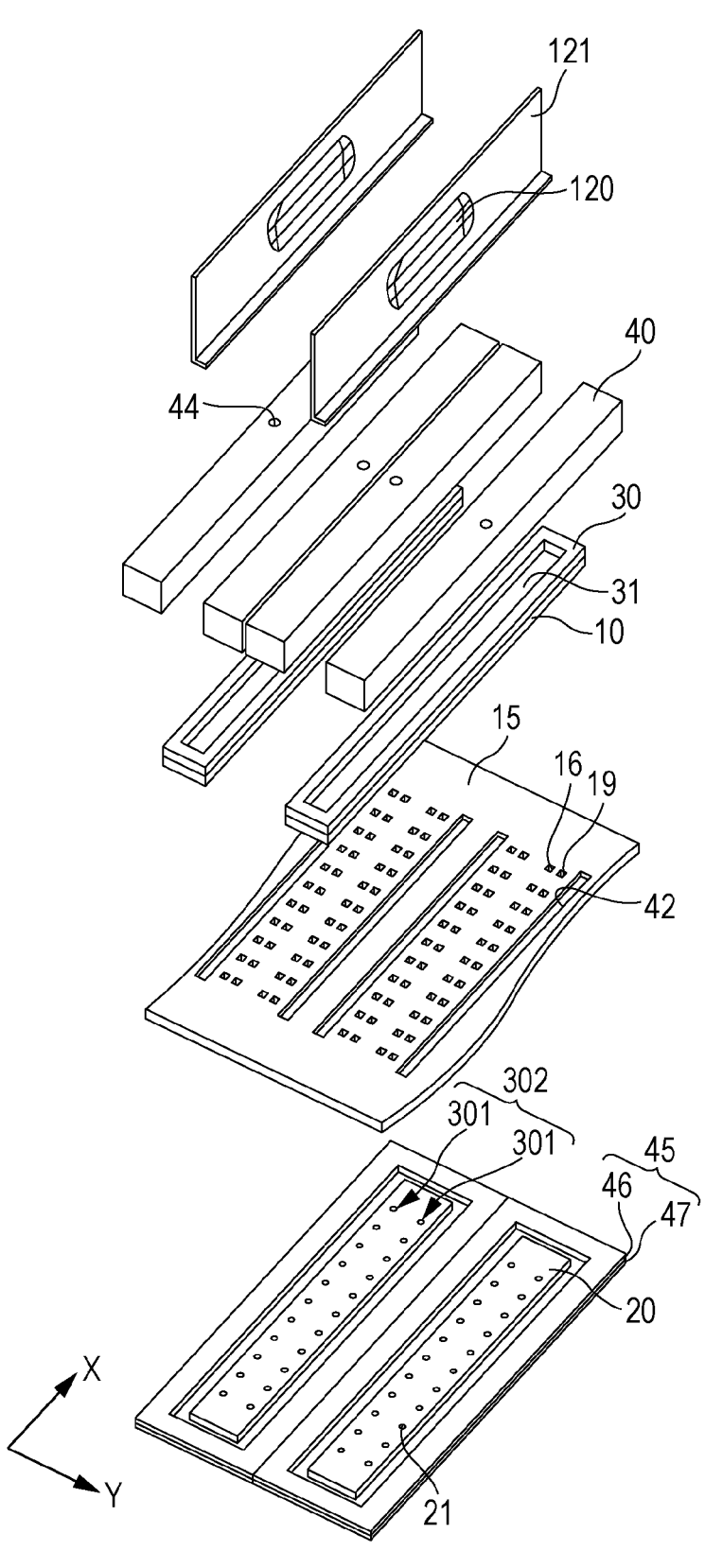
FIG. 3 is an exploded perspective view showing a portion of the head unit marked as III in FIG. 2.
Figure 4A:
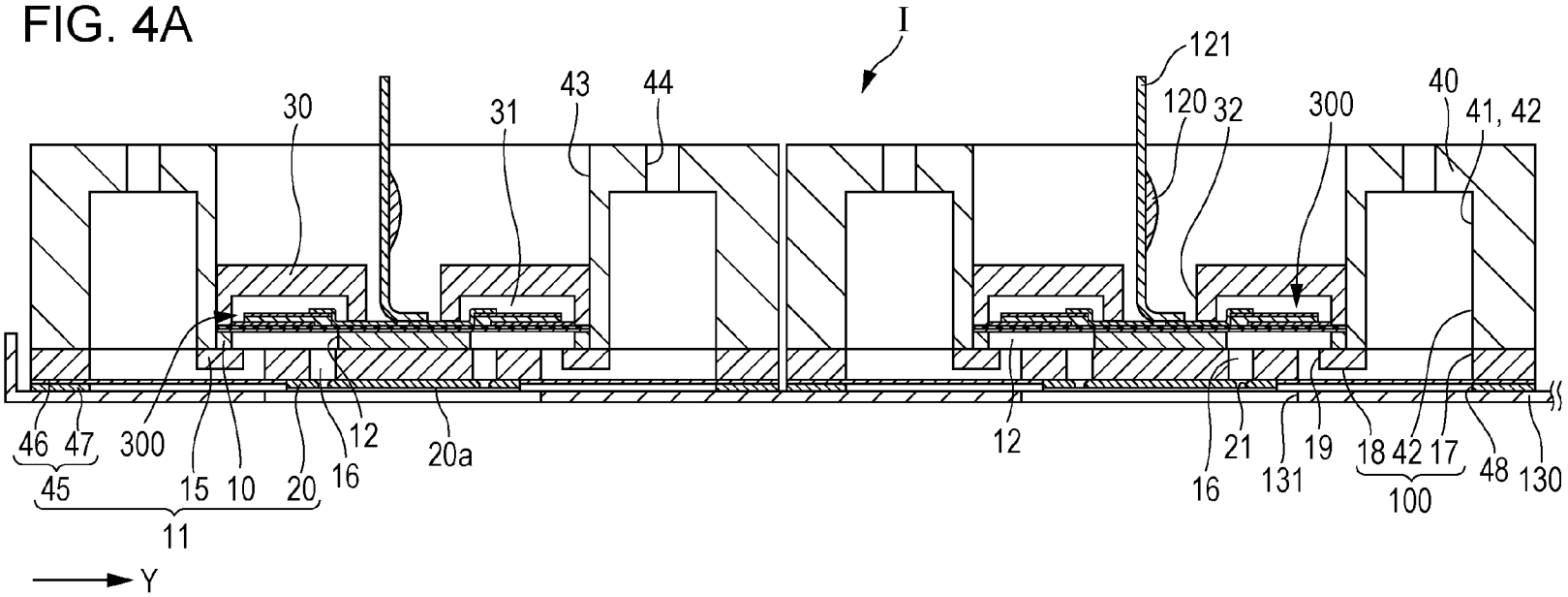
FIG. 4A is a cross-sectional view of the head unit taken along a line IV-IV in FIG. 2.
Figure 4B:
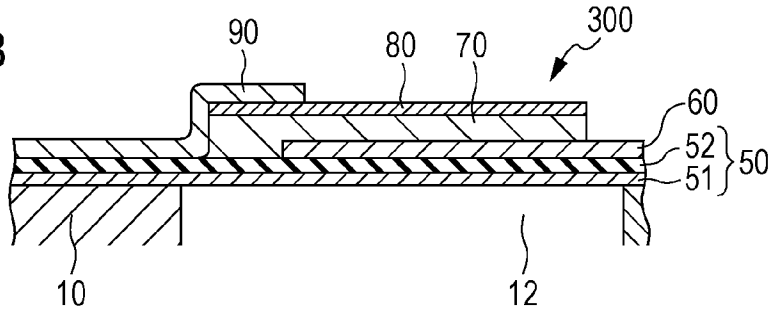
FIG. 4B is an enlarged cross-sectional view of a part of FIG. 4A.
Figure 5:
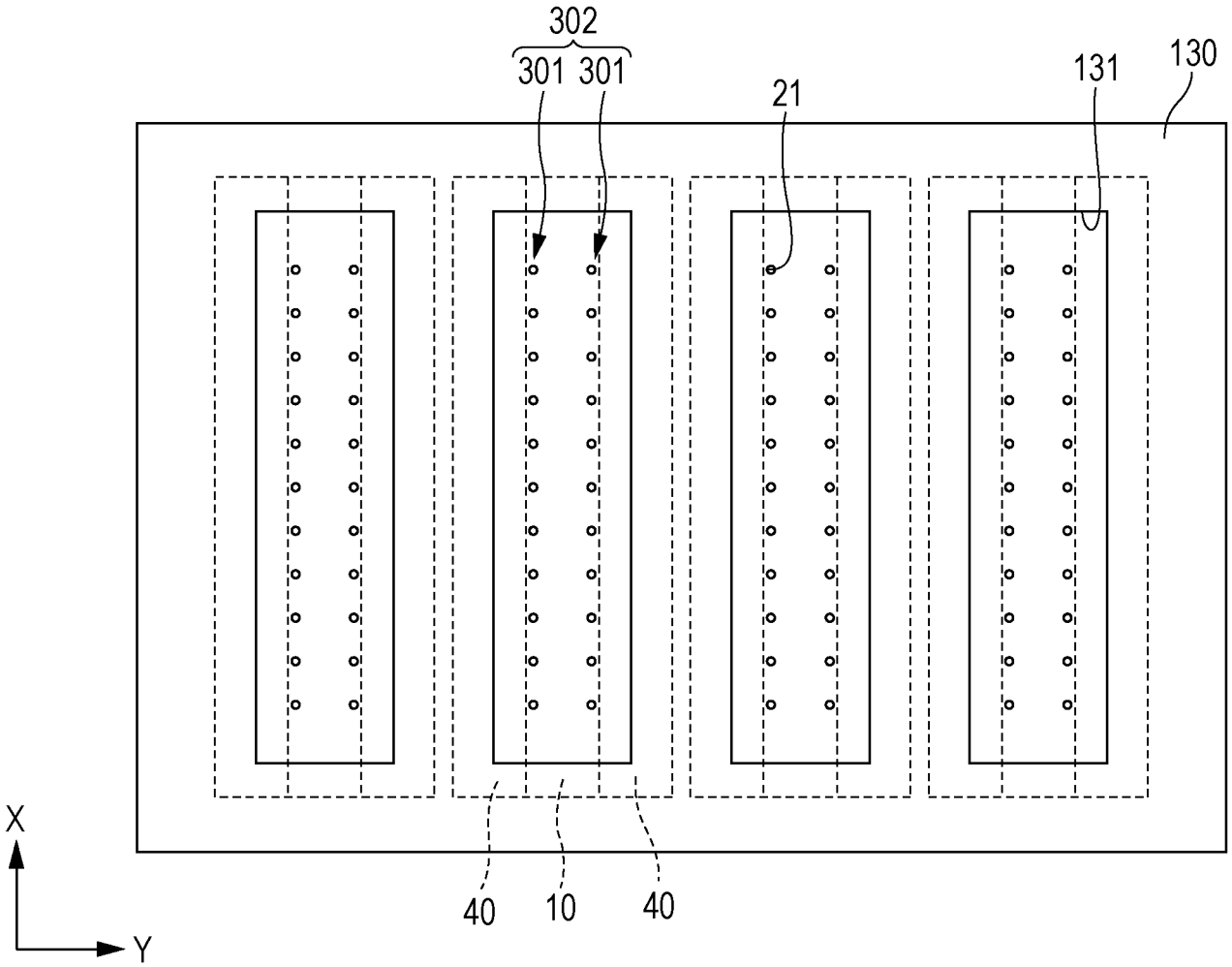
FIG. 5 is a bottom view of the head module including the head unit.

Referring now to FIGS. 2 to 4B, the ink jet recording head unit will be described. FIGS. 3, 4A and 4B illustrate only a part of the head unit shown in FIG. 2.

As illustrated, the head unit I includes a plurality of components such as a head unit main body 11 and a housing 40, which are joined together with an adhesive or the like. In this embodiment, the head unit main body 11 includes a plurality of flow path substrates 10, a communication plate (supply substrate) 15, a plurality of nozzle plates 20, a plurality of piezoelectric actuators 300, a plurality of cover substrates 30, and a plurality of compliance substrates 45. Thus, in the head unit main body 11, the single communication plate 15 is associated in common with the plurality of flow path substrates 10 and the nozzle plates 20.

In this embodiment, four flow path substrates 10 are provided in the head unit main body 11. The flow path substrate 10 is formed of, for example, monocrystalline silicon. The flow path substrates 10 each include a plurality of pressure chambers 12, aligned in a first direction (X-direction) in which a plurality of nozzle openings 21 from which the ink of the same color is dispensed are aligned. A plurality of rows (in this embodiment, two) of the pressure chambers 12 are formed on the flow path substrates 10 along the alignment direction of the nozzle openings 21. The group composed of the plurality of pressure chambers formed on each of the flow path substrates 10 will hereafter be referred to as pressure chamber group.

A face of each flow path substrate 10 (opposite to a vibrating plate 50 to be described later) is joined to the communication plate 15. In other words, the plurality of flow path substrates 10 are joined to (stacked on) the single communication plate 15. In addition, the plurality of nozzle plates 20, each including the plurality of nozzle openings 21 respectively communicating with the pressure chambers 12, are joined to the communication plate 15. The communication plate 15 also includes another plurality of nozzle communication paths (different liquid flow paths) 16 each communicating between the pressure chamber 12 and the nozzle opening 21. The communication plate 15 is larger in area than the flow path substrates 10, and the nozzle plate 20 is smaller in area than the flow path substrate 10. Forming thus the nozzle plate 20 in a relatively small size contributes to reducing the manufacturing cost. In this embodiment, the surface including the nozzle openings 21 of the nozzle plate 20 and from which the ink droplets are dispensed will be referred to as liquid ejecting surface 20*a*.

The communication plate 15 also includes a first manifold portion 17 and a second manifold portion 18 constituting a part of a manifold 100.

The first manifold portion 17 is formed so as to penetrate through the communication plate 15 in a thickness direction (in the direction in which the communication plate 15 and the flow path substrate 10 are stacked).

The second manifold portion 18 is formed not to penetrate all the way through the communication plate 15, but so as to open toward the side of the liquid ejecting surface 20*a* of the communication plate 15.

Further, the communication plate 15 includes a plurality of ink supply paths (liquid supply paths) 19 respectively communicating with an end portion of the pressure chambers 12 in a second direction Y-direction, and respectively associated with the pressure chambers 12. The ink supply paths 19 each serve to communicate between the second manifold portion 18 and the pressure chamber 12.

It is preferable that the communication plate 15 is formed of a material having a linear expansion coefficient similar to that of the flow path substrate 10. In the case where a material having a linear expansion coefficient largely different from that of the flow path substrate 10 is employed to form the communication plate 15, the stacked structure of the flow path substrate 10 and the communication plate 15 is warped upon being heated or cooled, because of the different linear expansion coefficient. In this embodiment, the communication plate 15 is formed of the same material as the flow path substrate 10, i.e., monocrystalline silicon, and therefore the stacked structure is prevented from being warped by heat.

The nozzle plate 20 is also formed of monocrystalline silicon. Accordingly, the nozzle plate 20 and the communication plate 15 have the same linear expansion coefficient, and hence the stacked structure is prevented from being warped by being heated or cooled.

In this embodiment, the nozzle plates 20 each include two nozzle rows. In each row the nozzle openings 21 are aligned in the first direction X, and the two nozzle rows are aligned in the second direction Y. Each row including the nozzle openings 21 aligned in the first direction X will be referred to as nozzle row 301. The group of nozzle openings 21 formed in each nozzle plate 20 will be referred to as nozzle group 302. In this embodiment, accordingly, two nozzle rows 301 adjacent to each other constitute a nozzle group 302, and the head unit main body 11 includes four nozzle plates 20 and four nozzle groups 302.

The nozzle openings 21 are formed by dry etching, and includes a cylindrical portion having a constant inner diameter (straight portion) and a tapered portion in which the inner diameter gradually decreases toward the ejecting outlet from the side of the ink flow path. However, the nozzle opening 21 may have a constant inner diameter all the way to the ejecting outlet.

On the other face of the flow path substrate 10 (opposite to the communication plate 15), the vibrating plate 50 is provided. The vibrating plate 50 according to this embodiment includes an elastic film 51 formed on the flow path substrate 10 and a dielectric film 52 formed on the elastic film 51. Here, the pressure chamber 12 is formed by anisotropic etching performed on the flow path substrate 10 from the side of the communication plate 15, and the opposite side of the pressure chamber 12 is defined by the vibrating plate 50 (elastic film 51).

A piezoelectric actuator 300 including a first electrode 60, a piezoelectric layer 70, and a second electrode 80 is provided on the vibrating plate 50, for generating a pressure. Generally, a common electrode is provided so as to serve as one of the electrodes of each piezoelectric actuator 300, and the other electrode and the piezoelectric layer 70 are patterned for each of the pressure chambers 12. In this case, the portion composed of the other electrode and the piezoelectric layer 70 formed by patterning and which produces a piezoelectric strain when a voltage is applied to the electrodes is called a piezoelectric active section. In this embodiment the first electrode 60 corresponds to the common electrode for the piezoelectric actuators 300 and the second electrode 80 corresponds to the individual electrode of each piezoelectric actuator 300, however these electrodes may be arranged in the other way depending on the design of the driver circuit or wiring pattern. Although the vibrating plate 50 is composed of the elastic film 51 and the dielectric film 52 in this embodiment, the vibrating plate 50 may only include either of the elastic film 51 and the dielectric film 52 and, further, the elastic film 51 and the dielectric film 52 may be excluded from the vibrating plate 50 and the first electrode 60 alone may serve as the vibrating plate. Alternatively, the piezoelectric actuator 300 itself may actually serve as the vibrating plate. However, in the case where the first electrode 60 is directly formed on the flow path substrate 10, the first electrode 60 has to be protected by an insulative cover layer to prevent conduction between the first electrode 60 and the ink.

The piezoelectric layer 70 is formed of a piezoelectric material of an oxide having a polarized structure on the first electrode 60. For example, a perovskite-type oxide expressed by a general formula $ABO_3$ may be employed, in which A may contain lead and B may contain at least one of zirconium and titanium. B may further contain niobium. More specifically, the piezoelectric layer 70 may be formed of lead titanium zirconium oxide ($Pb(Zr, Ti)O_3$: PZT), lead niobium titanium zirconium oxide ($Pb(Zr, Ti, Nb)O_3$: PZTNS) containing silicon, and the like.

Alternatively, the piezoelectric layer 70 may be formed of a non-lead piezoelectric material, such as a perovskite composite oxide containing bismuth ferrate or bismuth ferrate manganate and barium titanate or bismuth potassium titanate.

An end portion of a lead electrode 90 is connected to the second electrode 80. The other end portion of the lead electrode 90 is connected to a circuit board 121 including a driver circuit 120, for example a COF.

A cover substrate 30 of generally the same size as the flow path substrate 10 is joined to the flow path substrate 10 on the side of the piezoelectric actuator 300. The cover substrate 30 includes a cavity 31 that protects the piezoelectric actuator 300. The cover substrate 30 also includes a through hole 32. The other end portion of the lead electrode 90 extends so as to be exposed in the through hole 32, and the lead electrode 90 and the circuit board 121 are electrically connected in the through hole 32.

The thus-configured head unit main body 11 includes a plurality of housings 40 that each define, in collaboration with the head unit main body 11, the manifold 100 communicating with the plurality of pressure chambers 12. The housings 40 have a rectangular shape in a plan view, and are fixed to the communication plate 15. The housings 40 each include a cavity 41, the opening of which communicates with the opening of the first manifold portion 17. Thus, the cavity 41 constitutes a third manifold portion 42. The first manifold portion 17 and the second manifold portion 18 formed in the communication plate 15, and the third manifold portion 42 defined by the housing 40 and the flow path substrate 10 constitute the manifold 100 according to this embodiment.

The housing 40 is provided for each of the nozzle rows 301 in this embodiment. Accordingly, the head unit I includes eight nozzle rows 301 and eight housings 40 respectively corresponding to the eight nozzle rows. In other words, the housings 40 are provided for the respective nozzle rows, independently from each other. In addition, since the manifolds 100 are provided for the respective nozzle rows 301, the housings 40 may also be described as respectively corresponding to the manifolds 100.

The housing 40 may be formed of a resin or a metal, for example. The cover substrate 30 may preferably be formed of a material having a similar linear expansion coefficient to that of the flow path substrate 10 to which the cover substrate 30 is bonded, and monocrystalline silicon is employed in this embodiment.

Further, a compliance substrate 45 is provided on the face of the communication plate 15 oriented to the liquid ejecting surface 20*a*, so as to correspond to the openings of the first manifold portion 17 and the second manifold portion 18. The compliance substrate 45 seals the openings of the first manifold portion 17 and the second manifold portion 18 on the side of the liquid ejecting surface 20*a*.

In this embodiment, the compliance substrate 45 includes a sealing film 46 and a fixing substrate 47. The sealing film 46 is formed of a flexible thin film of, for example, polyphenylene sulfide (PPS) or stainless steel (SUS) not thicker than 20 μm, and the fixing substrate 47 is formed of a hard material such as stainless steel (SUS) or other metals. The region of the fixing substrate 47 corresponding to the manifold 100 is completely cut away in the thickness direction so as to form an opening 48, and therefore the opening of the manifold 100 constitutes a compliance portion, which is a flexible portion solely sealed with the sealing film 46.

The housings 40 each include an introduction path 44 communicating with the manifold 100 for supplying the ink to the manifold 100. The housing 40 also includes a connection port 43 communicating with the through hole 32 of the cover substrate 30 so that the circuit board 121 can be inserted in the through hole 32.

When the ink jet recording head unit I configured as above is to eject the ink, the ink is supplied from the ink cartridge 3 through the introduction path 44, and the flow path from the manifold 100 to the nozzle opening 21 is filled with the ink. Then a voltage is applied to the piezoelectric actuators 300 respectively corresponding to the pressure chambers 12 according to a signal from the driver circuit 120, to thereby deflect the elastic film 51 and the dielectric film 52 together with the piezoelectric actuator 300. Accordingly, the pressure in the pressure chamber 12 is increased so that the ink droplet is ejected from the predetermined nozzle opening 21.

In this embodiment, the head unit I includes the plurality of flow path substrates 10 and nozzle plates 20, but includes just a single communication plate 15. In other words, the communication plate 15 is associated in common with the plurality of nozzle groups 302 and the plurality of pressure chamber groups. Providing thus the communication plate 15 in common for the nozzle groups 302 and the pressure chamber groups as in this embodiment allows the head unit I to be built in a reduced size in the alignment direction of the nozzle rows 301.

In the case of fixing head bodies in alignment on a base member to form a head unit that includes a plurality of head bodies, a certain clearance has to be secured between the head bodies when moving the head bodies for alignment with each other. Accordingly, the head bodies are fixed with a spacing between each other instead of close to each other, which naturally leads to an increase in size of the head unit. In this embodiment, on the contrary, since the communication plate 15 is a common member the flow path substrates 10 and the nozzle plates 20 can be aligned about the communication plate 15, and there is no need to provide a spacing between the flow path substrates or between the nozzle plates. Thus, the head unit I can be made smaller in size than in the case of aligning the head bodies on the base member.

In the head unit I configured as above, the housings 40 are individually provided for the respective manifolds 100 and the nozzle rows 301, and therefore a thermal impact from the ink in the manifold 100 of other nozzle rows 301 can be suppressed, and resultantly the printing characteristics can be stabilized. To be more detailed, when a larger amount of ink is dispensed from a certain nozzle row 301, the temperature of the ink in the manifold 100 corresponding to this nozzle row 301 is increased. At this point, in the case where the housing 40 is provided in common for the plurality of manifolds 100, the heat is transmitted through inside the housing 40 to other manifolds 100. Therefore, the temperature of the ink in other manifolds 100 is also increased, which incurs fluctuation in dispensation characteristics of the ink. In contrast, since the housings 40 are individually provided for the respective manifolds 100 in this embodiment, the thermal impact and the resultant fluctuation in dispensation characteristics can be suppressed, which leads to stabilized printing quality.

In the head unit I, further, the flow path substrate 10 has a reduced size. More specifically, the flow path substrate 10 according to this embodiment is smaller than the communication plate 15 rather than the same. Such a configuration allows the flow path substrate 10, which is an expensive component, to be built at a lower cost, thereby reducing the manufacturing cost and improving the production yield.

Although the housings 40 are respectively provided for the nozzle rows 301, i.e., the manifolds 100 in this embodiment, the housing 40 may be formed as a continuous single body including a plurality of cavities 41 corresponding to the respective nozzle rows 301. Such a configuration is unable to block the thermal impact from other manifolds, however eliminates the need to provide a plurality of housings and reduces the manufacturing cost.

Further, to increase the density of the nozzle pattern in the configuration according to this embodiment, one nozzle row 301 may be shifted with respect to the other nozzle row 301 in the same nozzle group 302, in the alignment direction of the nozzle opening 21 by half a pitch between the nozzles. In this case, the housing 40 may be provided in common for the nozzle rows that dispense the ink of the same color, and also the cavity 41 may be provided in common for the nozzle rows of the same color. With such a configuration, it suffices to provide a single introduction path 44 for one housing provided in common, and hence the ink introduction device is simplified, which is a preferable aspect. However, basically it is more preferable to individually provide the housings 40 for the respective nozzle rows 301 as in this embodiment, because of the advantage in that the thermal impact and the resultant fluctuation in dispensation characteristics can be suppressed.

Although the communication plate 15 is provided in common for all of the nozzle rows in this embodiment, different configurations may be adopted. For example, the communication plate 15 may be provided in common for a pair of nozzle groups, and two of such communication plates 15 may be provided for totally four nozzle groups, as in this embodiment. Nevertheless, basically it is more preferable to provide a single communication plate 15 in common for the four nozzle groups as in this embodiment, because of the advantage in that the head unit can be built in a reduced size.

Second Embodiment

A second embodiment of the invention represents a head unit employed in a line-type ink jet recording apparatus (hereinafter, line recording apparatus).

A head unit IA according to this embodiment is for use in the line recording apparatus IIA, unlike the head unit according to the first embodiment. More specifically, while the ink jet recording apparatus II according to the first embodiment is configured to move the head module 1 mounted on the carriage 2 in the main scanning direction, the line recording apparatus IIA according to this embodiment performs the printing by moving the recording medium S such as a paper sheet in the main scanning direction, with a head module 1A fixed.

Figure 6:
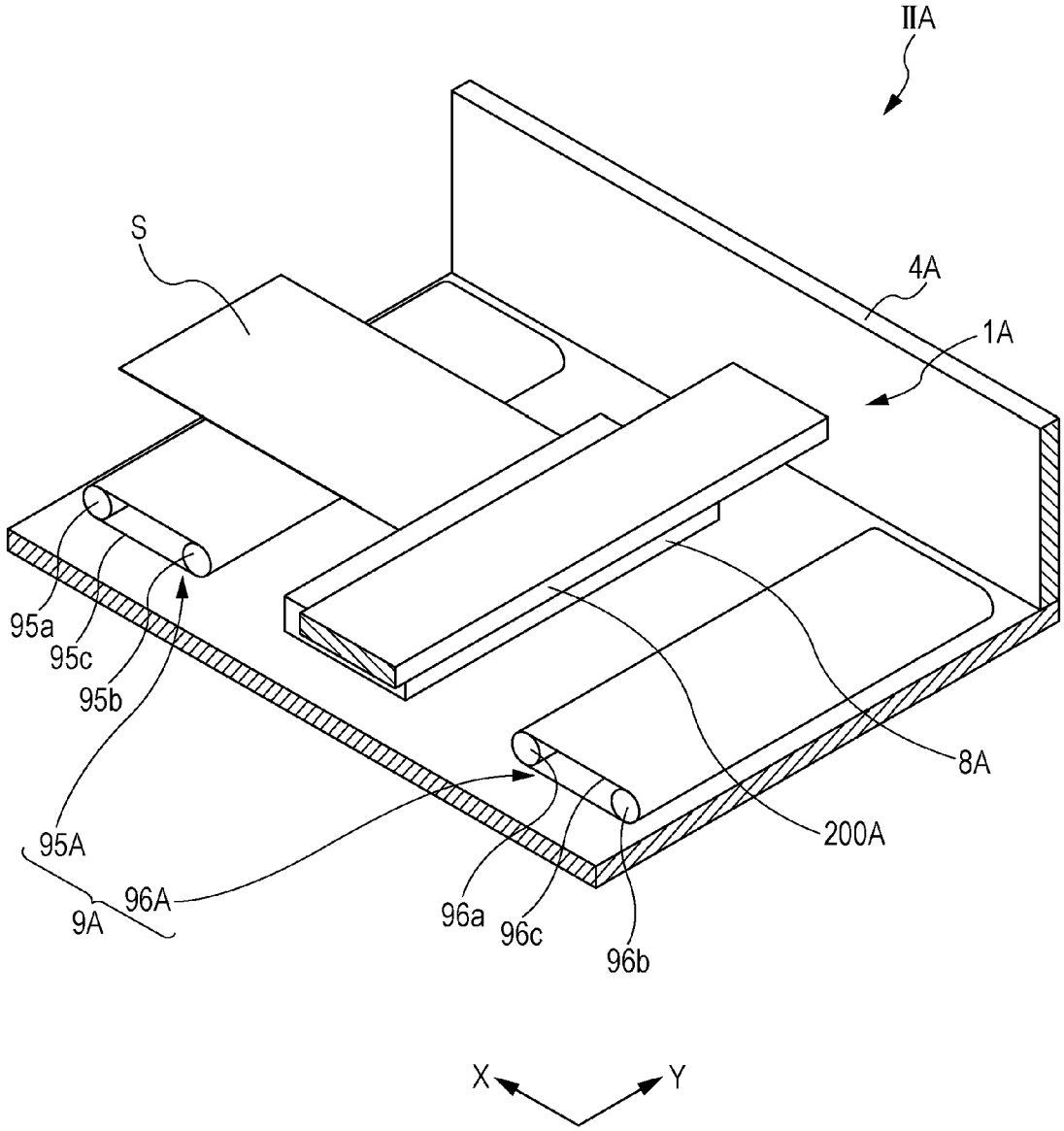
FIG. 6 is a perspective view showing a liquid ejecting apparatus according to a second embodiment of the invention.

FIG. 6 illustrates an example of the line recording apparatus configured as above.

As shown in FIG. 6, the line recording apparatus IIA according to this embodiment performs the printing by transporting the recording medium S such as a paper sheet, which is the target of ejection, with the head module 1A fixed.

The line recording apparatus IIA includes an apparatus main body 4A, the head module 1A fixed to the apparatus main body 4A, a transport unit 9A that transports the recording medium S, and a platen 8A that supports the back face of the recording medium S opposite to the printing surface opposed to the head module 1A.

The head module 1A includes a casing 200A, in which the head unit is provided. The head module 1A is fixed to the apparatus main body 4A with the nozzle openings of the head unit aligned in a direction intersecting the transport direction of the recording medium S.

The transport unit 9A includes a first transport unit 95A and a second transport unit 96A located on the respective sides of the head module 1A in the transport direction of the recording medium S.

The first transport unit 95A includes a driving roller 95*a*, a slave roller 95*b*, and a transport belt 95*c* wound over the driving roller 95*a* and the slave roller 95*b*. The second transport unit 96A includes, like the first transport unit 95A, a driving roller 96*a*, a slave roller 96*b*, and a transport belt 96*c*.

Non-illustrated driving units including a driving motor or the like are respectively connected to the driving rollers 95*a*, 96*a* of the first transport unit 95A and the second transport unit 96A, so that when the transport belts 95*c*, 96*c* are made to rotate by the driving force of the driving unit the recording medium S is caused to move at upstream and downstream positions of the head module 1A.

Although the first transport unit 95A and the second transport unit 96A according to this embodiment include the driving roller 95*a*, 96*a*, the slave roller 95*b*, 96*b*, and the transport belt 95*c*, 96*c*, respectively, a holding device that retains the recording medium S on the transport belt 95*c*, 96*c* may further be provided. For example, a charger that charges the surface of the recording medium S may be provided, so that the recording medium S that has been charged is adsorbed to the transport belt 95*c*, 96*c* by a dielectric polarization effect. Alternatively, a pressure roller may be provided on the transport belt 95*c*, 96*c*, so as to nip the recording medium S between the pressure roller and the transport belt 95*c*, 96*c*.

The platen 8A is located between the first transport unit 95A and the second transport unit 96A so as to oppose the head module 1A, and formed of a metal or a resin in a shape having a rectangular cross-section. The platen 8A serves to support the recording medium S being transported by the first transport unit 95A and the second transport unit 96A, at the position opposite the head module 1A.

Here, the platen 8A may include an adsorption unit that adsorbs the recording medium S being transported, onto the platen 8A. The adsorption unit may be, for example, a suction unit that attracts the recording medium S by a suction force, or an electrostatic device that adsorbs the recording medium S by an electrostatic force.

Though not shown in FIG. 6, an ink storage unit containing the ink such as an ink tank or an ink cartridge is connected to the head module 1A, for supplying the ink. The ink storage unit may be mounted on the head module 1A or located in the apparatus main body 4A at a position different from the head module 1A and connected to the head module 1A via a tube or the like. Further, non-illustrated wirings routed from outside are connected to the head units in the head module 1A.

In the line recording apparatus IIA configured as above, the first transport unit 95A transports the recording medium S and the head module 1A performs the printing on the recording medium S supported by the platen 8A. The recording medium S that has undergone the printing operation is transported by the second transport unit 96A.

Figure 7:
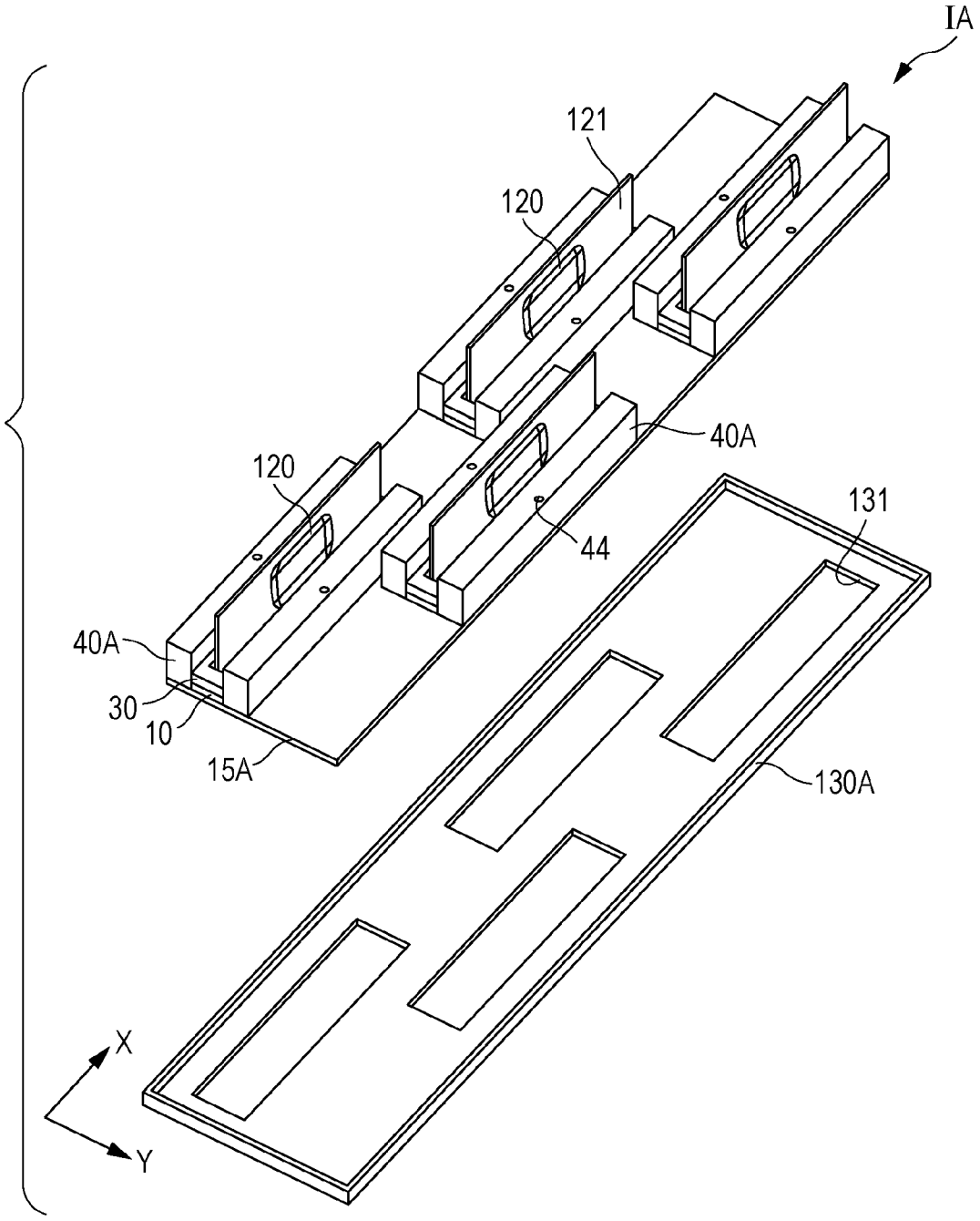
FIG. 7 is an exploded perspective view showing a head module including a head unit.
Figure 8:
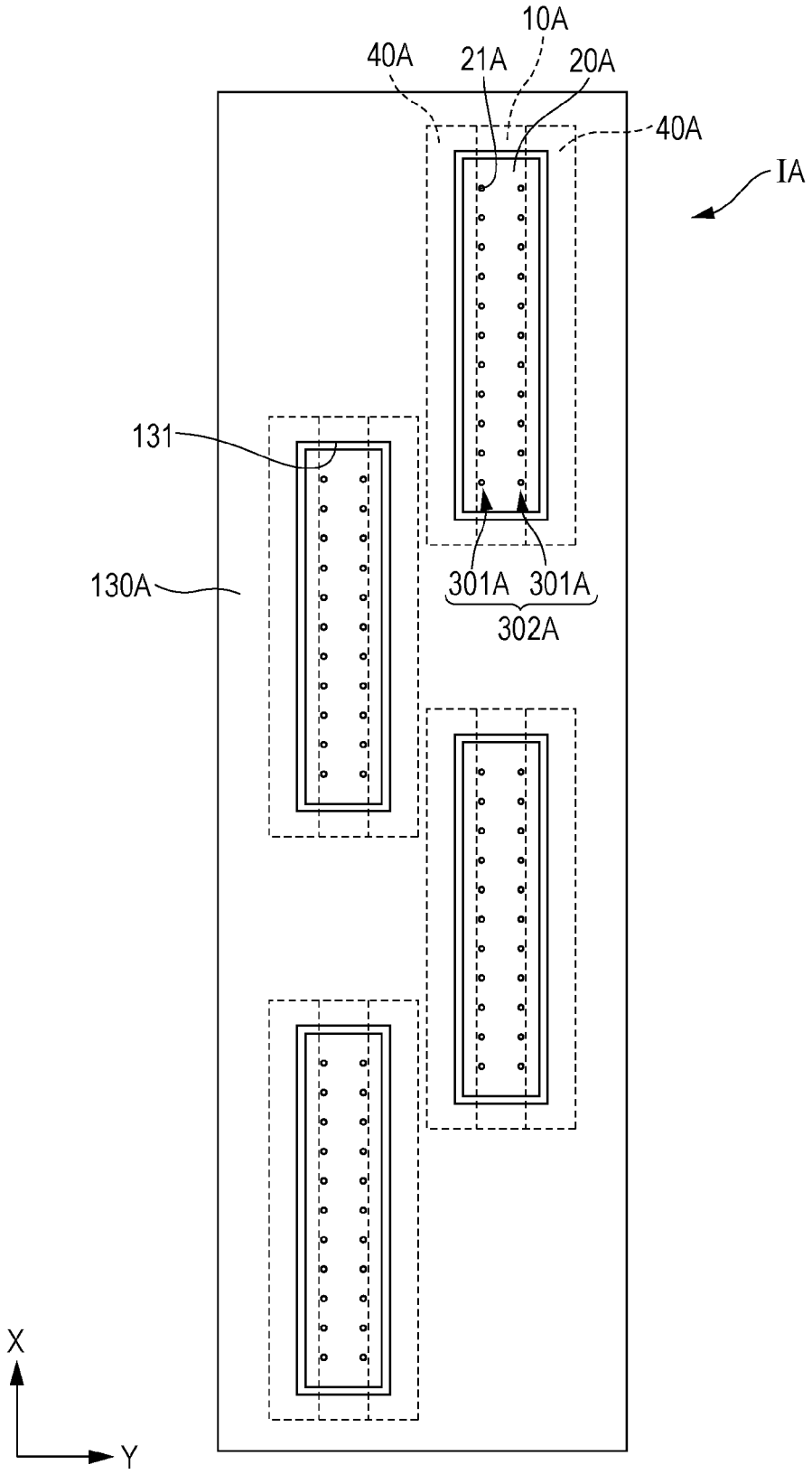
FIG. 8 is a bottom view of the head module including the head unit.

Referring to FIG. 7, the head module 1A includes a head unit IA installed inside the casing 200A, and a fixing plate 130A located on the face of the casing 200A oriented to a liquid ejecting surface. The head unit IA will be described in further details hereunder, referring to FIGS. 7 and 8. Description of the same constituents as those of the first embodiment will not be repeated.

As illustrated, the head unit IA includes four nozzle plates 20A, in other words four nozzle groups 302A. Among the nozzle groups 302A, two nozzle groups 302A are aligned in the alignment direction of a nozzle row 301A. The row of the other two nozzle groups 302A is shifted with respect to the first mentioned row of the nozzle groups 302A in the alignment direction of the nozzle openings 21A. In other words, the nozzle groups 302A are arranged in a checkerboard pattern in the head unit IA.

In addition, on the head unit IA, an end portion of one of the nozzle groups 302A in one of the nozzle group rows overlaps an end portion of one of the nozzle groups 302A in the other nozzle group row, in the alignment direction of the nozzle openings 21A. With such a configuration, all of the nozzle rows of the head unit IA in the head module 1A are continuously aligned, so as to constitute a nozzle row unit that defines a maximum printing width as a whole.

The head unit IA configured as above also includes a single communication plate 15A as shown in FIG. 7, and a plurality of (four in this embodiment) flow path substrates 10A and nozzle plates 20A are associated with the single communication plate 15A. In other words, the communication plate 15A is provided in common for the plurality of flow path substrates 10A and nozzle plates 20A.

Housings 40A are individually provided for the respective nozzle rows 301A.

Thus, the head unit IA includes the single communication plate 15A, which is provided for the plurality of flow path substrates 10A. Accordingly, in this embodiment also, the plurality of flow path substrates 10A are associated with the single communication plate 15A.

With the mentioned configuration of the head unit IA including the single communication plate 15A and the plurality of flow path substrates 10A and the plurality of nozzle plates 20A, the head unit IA according to this embodiment can also be built in a reduced size in the Y-direction orthogonal to the alignment direction of the nozzles, as in the first embodiment.

In addition, since the housings 40A are individually provided for the respective nozzle rows 301A in this embodiment also, the ink supplied to each nozzle row is protected from the thermal impact from other manifolds.

Third Embodiment

A third embodiment represents the head unit IA according to the second embodiment, in which the housings 40A are substituted with housings 40B.

Figure 9:
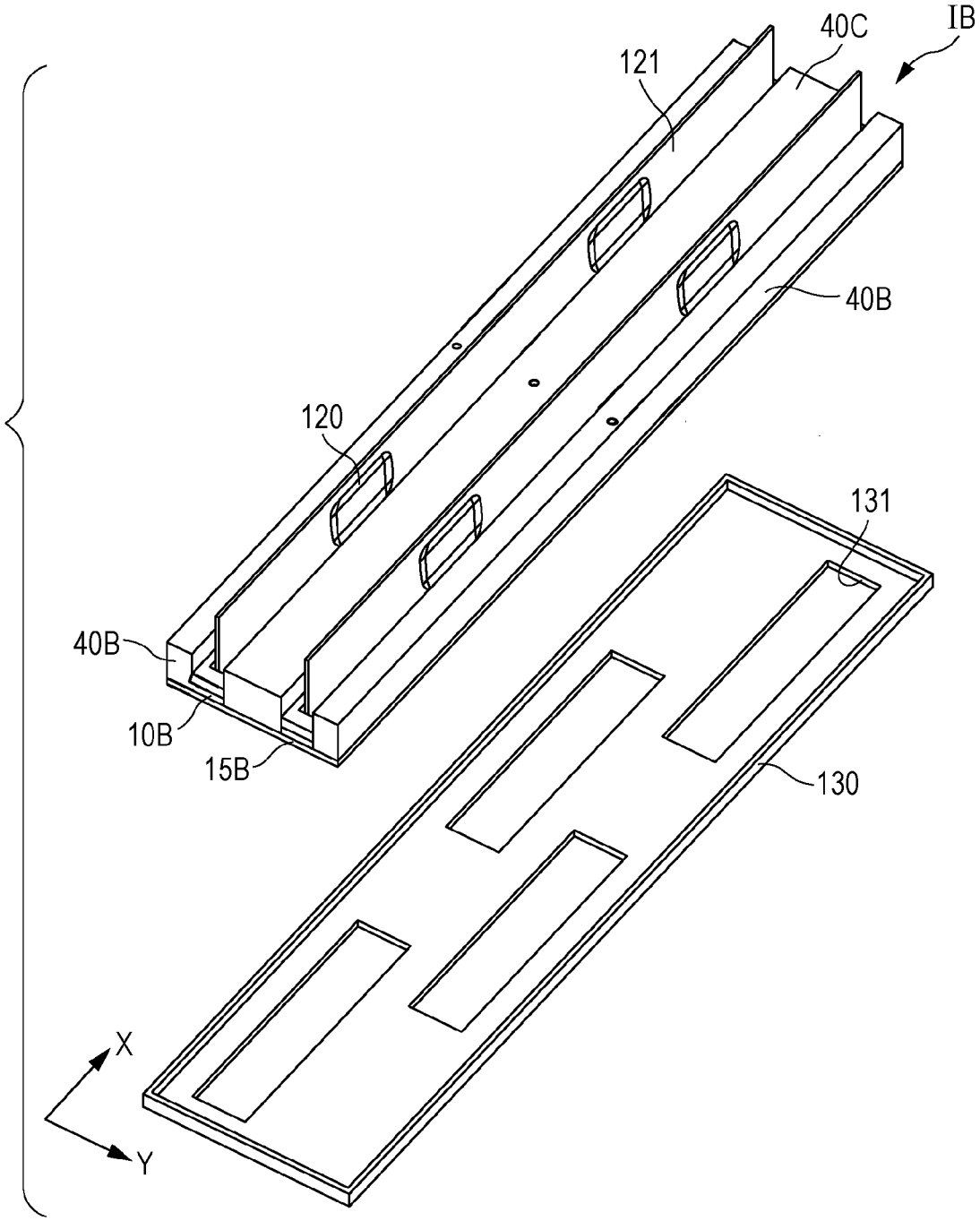
FIG. 9 is an exploded perspective view showing a head module including a head unit according to a third embodiment of the invention.
Figure 10:
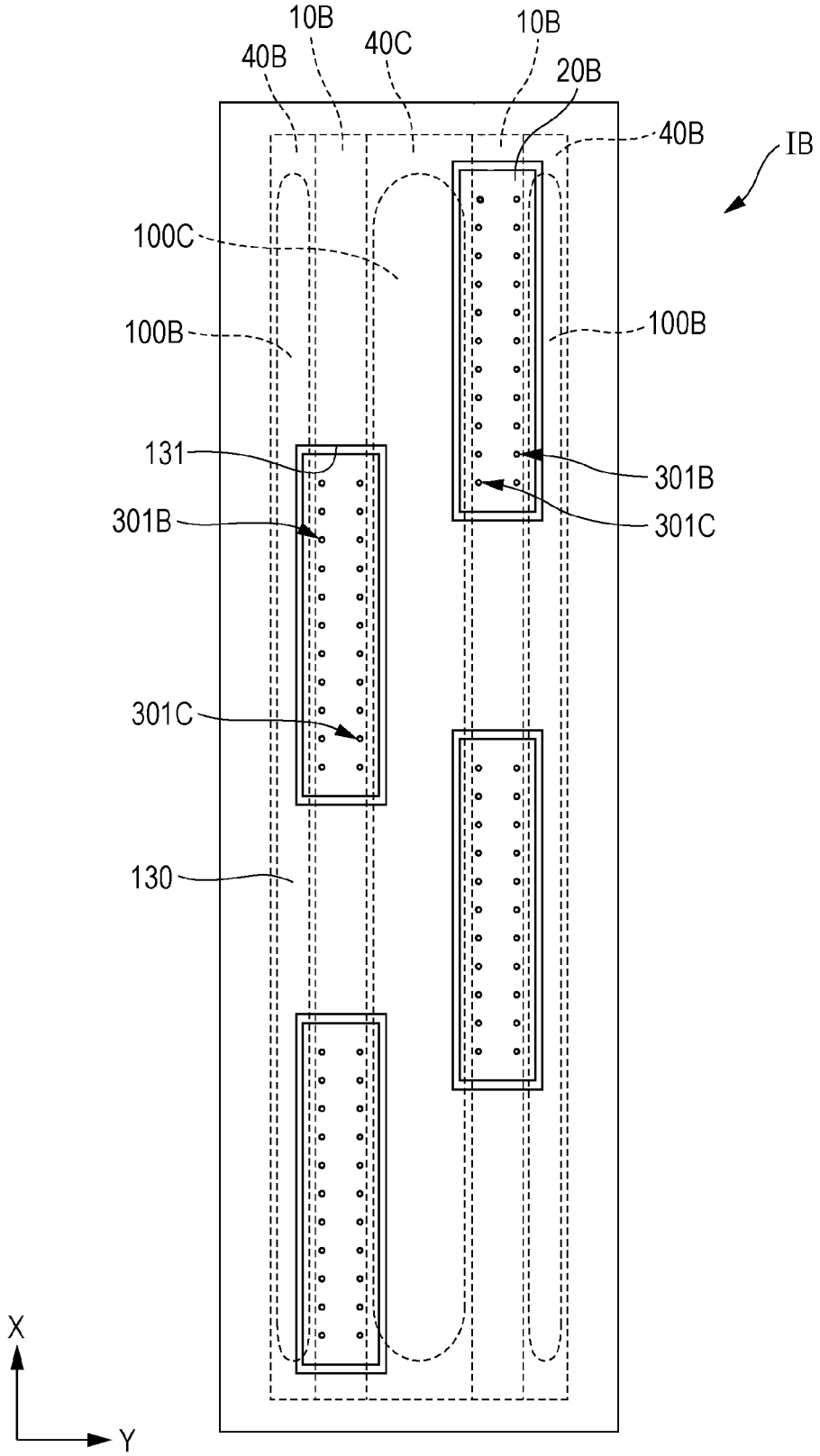
FIG. 10 is a bottom view of the head module including the head unit.

As shown in FIGS. 9 and 10, a head unit IB according to this embodiment includes two housings 40B provided in common for the two nozzle rows 301B located in an outer region of the communication plate 15B. In addition, a housing 40C is provided in common for the four nozzle rows 301C located in an inner region of the communication plate 15B. Thus, the head unit IB includes two housings 40B and one housing 40C. In this embodiment, the housings 40B and 40C are disposed to cover a plurality of nozzle rows.

In the housings 40B, 40C according to this embodiment, manifolds 100B, 100C are each provided in common for a plurality of nozzle rows. The ink of the same color is introduced in one manifold in this embodiment, and therefore the housings 40B, 40C include a single manifold 100B, 100C, respectively. The housings 40B, 40C each include an introduction path 44.

With the mentioned configuration of the head unit IB including the single communication plate 15B and the plurality of flow path substrates 10B and the plurality of nozzle plates 20B, the head unit IB according to this embodiment can also be built in a reduced size in the Y-direction orthogonal to the alignment direction of the nozzles, as in the first embodiment.

In this embodiment, further, the manifolds 100B, 100C and the housings 40B, 40C are each provided in common for the plurality of nozzle rows, and the housings 40B, 40C each include a single introduction path 44. Such a configuration simplifies the ink introduction system, and hence simplifies the manufacturing process.

In the housings 40B, 40C, the ink of different colors may be introduced in the case where the housings 40B, 40C each include individual cavities constituting the respective manifolds 100B, 100C. Naturally, the manifolds may be individually provided for the respective nozzle rows, also in the case where the ink of the same color is introduced.

Additional Embodiments

The invention is in no way limited to the foregoing embodiments.

In the head unit I according to the first embodiment, the flow path substrate 10 is located on the communication plate 15 in the position between the housings 40, the nozzle plate 20 including the nozzle group 302 is located at the position corresponding to the flow path substrate 10 on the communication plate 15, and the communication plate 15 includes the ink supply path 19 communicating between the cavity 41 of the housing 40 and the pressure chamber 12 and the nozzle communication path 16 communicating between the pressure chamber 12 and the nozzle opening 21 in the nozzle plate 20, however different configurations may be adopted. It suffices that at least two flow path substrates 10 are provided on one communication plate 15.

Although the compliance substrate 45 is individually provided for each nozzle row 301 in the foregoing embodiment, the compliance substrate 45 may be provided in common for the entirety of the nozzle group 302.

In the ink jet recording apparatus II, the ink cartridge is mounted on the carriage. Instead, an ink storage unit such as an ink tank may be provided in the apparatus main body 4, and the liquid storage unit and the ink jet recording head unit I may be connected via a tube or the like. Further, it is not mandatory that the liquid storage unit is installed in the ink jet recording apparatus II.

Although the ink jet recording head and the ink jet recording apparatus have been described as examples of the liquid ejecting head and the liquid ejecting apparatus respectively, the invention is broadly applicable to liquid ejecting heads and liquid ejecting apparatuses, including those that eject a liquid other than the ink. Examples of such liquid ejecting head include recording heads employed in image recording apparatuses such as a printer, color material ejecting heads for manufacturing color filters for LCDs, electrode material ejecting heads for manufacturing electrodes for organic electroluminescence (EL) displays or field emission displays (FED), and bioorganic ejecting heads for manufacturing biochips, and the invention is also applicable to liquid ejecting apparatuses including any of the liquid ejecting heads cited above.

What is claimed is:

1. A liquid ejecting head unit comprising:

a first nozzle group including a plurality of nozzles;

a second nozzle group including a plurality of nozzles different from the nozzles of the first nozzle group;

a first flow path substrate including a first pressure chamber group including a plurality of first pressure chambers that eject a liquid from the nozzles of the first nozzle group upon being subjected to a pressure;

a second flow path substrate, which is a different structure than the first flow path substrate, including a second pressure chamber group including a plurality of second pressure chambers that eject a liquid from the nozzles of the second nozzle group upon being subjected to a pressure, the second flow path substrate being different from the first flow path substrate; and a supply substrate including a first liquid supply path through which the liquid is supplied to the first pressure chamber group, and a second liquid supply path through which the liquid is supplied to the second pressure chamber group, the supply substrate being stacked between the first flow path substrate and a nozzle plate defining the first nozzle group or the second nozzle group, and being stack between the second flow path substrate and the nozzle plate.

2. The liquid ejecting head unit according to claim 1, wherein the supply substrate includes a plurality of openings each communicating with one of the first and the second liquid supply path and formed in the supply substrate on a surface thereof oriented to the flow path substrate, the liquid ejecting head unit further comprising a housing including a plurality of cavities each communicating with one of the first and the second liquid supply path via the opening, the housing being mounted on the supply substrate on the side of the flow path substrate.

3. The liquid ejecting head unit according to claim 2, wherein each of the nozzle groups includes a plurality of nozzle rows each including the nozzles aligned in one direction, and the housing includes a plurality of cavities respectively corresponding to the nozzle rows.

4. The liquid ejecting head unit according to claim 2, wherein each of the nozzle groups includes a plurality of nozzle rows each including the nozzles aligned in one direction, and the housing includes a cavity corresponding to the plurality of nozzle rows.

5. The liquid ejecting head unit according to claim 3, wherein the cavity constitutes a part of a manifold.

6. The liquid ejecting head unit according to claim 1, wherein at least the first flow path substrate is provided on the supply substrate between a pair of the housings, a nozzle plate including the nozzle group is provided on the supply substrate at a position opposing the first flow path substrate, and the supply substrate includes the liquid supply path connecting between the cavity of the housing and the pressure chamber, and another liquid flow path connecting between the pressure chamber and the nozzle in the nozzle plate.

7. The liquid ejecting head unit according to claim 1, further comprising:

a nozzle plate including the first nozzle group; and a nozzle plate including the second nozzle group.

8. A liquid ejecting apparatus comprising the liquid ejecting head unit according to claim 1.

9. A liquid ejecting apparatus comprising the liquid ejecting head unit according to claim 2.

10. A liquid ejecting apparatus comprising the liquid ejecting head unit according to claim 3.

11. A liquid ejecting apparatus comprising the liquid ejecting head unit according to claim 4.

12. A liquid ejecting apparatus comprising the liquid ejecting head unit according to claim 5.

13. A liquid ejecting apparatus comprising the liquid ejecting head unit according to claim 6.

14. A liquid ejecting apparatus comprising the liquid ejecting head unit according to claim 7.

15. The liquid ejecting head unit according to claim 1, further comprising:

a first circuit board configured to activate the first pressure chamber group; and a second circuit board configured to activate the second pressure chamber group.

* * * * *